US006766139B2

(12) United States Patent
Chueh et al.

(10) Patent No.: US 6,766,139 B2
(45) Date of Patent: Jul. 20, 2004

(54) DOCUMENT PROPERTY DETECTING DEVICE

(75) Inventors: Chuang-hua Chueh, Hsinchu (TW); Ming-fu Hsu, Hsinchu (TW); Chih-wei Peng, Hsinchu (TW)

(73) Assignee: Avision Inc., Hsinchu (TW)

( * ) Notice: Subject to any disclaimer, the term of this patent is extended or adjusted under 35 U.S.C. 154(b) by 80 days.

(21) Appl. No.: 10/301,148

(22) Filed: Nov. 20, 2002

(65) Prior Publication Data

US 2004/0062581 A1 Apr. 1, 2004

(30) Foreign Application Priority Data

Sep. 30, 2002 (TW) ..... 91122585 A

(51) Int. Cl.[7] ..... G03G 15/00
(52) U.S. Cl. ..... 399/376; 358/449; 355/75
(58) Field of Search ..... 399/370, 376, 399/389; 355/56, 75; 358/449; 382/286; 400/708

(56) References Cited

U.S. PATENT DOCUMENTS 4,585,332 A * 4/1986 Shenoy ..... 399/86
4,614,874 A * 9/1986 Fukuda et al. ..... 250/559.19
4,823,165 A * 4/1989 Narukawa et al. ..... 355/75
4,874,957 A * 10/1989 Sasaki et al. ..... 250/208.1
5,016,049 A * 5/1991 Onishi et al. ..... 399/32
5,036,354 A * 7/1991 Miyamoto ..... 355/75
5,321,273 A 6/1994 Kamiyama et al.
5,500,725 A 3/1996 Takasu et al.
5,805,970 A * 9/1998 Kasamatsu ..... 399/376

FOREIGN PATENT DOCUMENTS

JP 04025829 A * 1/1992 ..... G03B/27/62

* cited by examiner

*Primary Examiner*—Ren Yan
(74) *Attorney, Agent, or Firm*—Pro-Techtor Inter-National Services

(57) ABSTRACT

A document property detecting includes a circuit comprising a first electrode and a plurality of second electrodes, a transparent conductive substrate electrically connected to the first electrode for loading a document, and a cover with a plurality of conductive media electrically connected to the second electrodes, respectively.

11 Claims, 3 Drawing Sheets

DOCUMENT PROPERTY DETECTING DEVICE

BACKGROUND OF THE INVENTION

1. Field of the Invention

The invention relates to a document property detecting device, and more particularly, to a document property detecting device classified as document processing peripherals such as scanners and copiers.

2. Description of the Related Art

Accompanied with the rise of copiers, scanners, and multifunction peripherals during the recent years, people have gained convenience over document processing such as the copying, scanning, data storage, and sending of documents. Document processing has become a daily task for people, and therefore it is a vital issue as how to optimize the efficiency and convenience of document processing regarding to the design of multifunction peripherals.

During the document processing, it is important to get good control over the document size/location (generally called the document property). Take the flatbed scanner for instance, the document size and location have to be defined before scanning a certain area of a document. Therefore, a prior flatbed scanner is generally designed to prescan the entire flatbed to ensure the document size and location before proceeding with the actual scanning. However, the area of the document is usually smaller than that of the flatbed, hence scanning the entire flatbed lengthens the timing needed for scanning, thereby significantly lowering the efficiency of document processing.

A prior flatbed scanner 10 as indicated in FIG. 1 includes a cover 1 and a flatbed body 3. The cover 1 is provided with a platen 2. The flatbed body 3 is composed of a transparent glass 31, a light source 32 provided beneath the transparent glass 31, a plurality of photosensors 33 and a charge coupled device (CCD) 34. The photosensors 33 and the CCD 34 generally compose a CCD sensing module. It is to be noticed that the photosensors 33 are not necessarily be separated at a certain distance from the CCD 34 so that the CCD sensing module can be a minute sensing module. Further, the CCD sensing module can comprise a lens for focusing images within large areas to small areas. Therefore, the diagram is used merely for indicative purposes. During the scanning process in which the cover 1 covers the transparent glass 31 at the top of the flatbed body 3, the photo-signals from a document 4 or reflected by the platen 2 are received by photosensors 33 provided beneath the transparent glass 31, converted to electric signals, and sent out via the CCD 34. The electric signals are then converted to digital signals via an analog-to-digital (ACD) converter (not shown) and sent to the computer for processing. Hence the size and location of the document are confirmed, and further image scanning of the document can be proceeded. FIG. 2 is the plane figure from top view of the flatbed body 3 in FIG. 1, mainly showing the configuration of the photosensors 33 provided beneath the transparent glass 31. For the reason that the detection of size and location of the document is determined by the configuration of the photosensors 33, the number of photosensors has to be increased and the configuration thereof has to be restricted to accurately detect the size of the document. Consequently, this not only increases the production cost and brings difficulties in the design, but also results in the document detecting device being only able to detect standard document sizes such as A4 and A3.

In addition, other related techniques on document size detecting devices known are, a document size detecting device disclosed by the U.S. Pat. No. 5,321,273, in which the device employs a combination of a light emitting element, a spectroscope, lens and photosensitive elements to detect the document size; and an original document reading device capable of automatically detecting the size of an original document disclosed by the U.S. Pat. No. 5,500,725, in which the device uses distance sensors, a threshold value setting means, an original document size deciding means and a reading controlling means to detect the document size. It is then observed that prior document size detecting devices mostly employ the configuration of optical elements such as CCD photosensitive elements, photosensors and distance sensors to detect the sizes and locations of documents. However, as described above, these configurations of optical elements are prone to bring high production cost and design difficulties. Moreover, the light path configuration frequently results in increase in the volume or thickness of the flatbed body of the scanning device. Therefore, the present invention is intended to provide a document property detecting device that is able to overcome the aforesaid disadvantages, offer conveniences over its design, and detect the size and location of the document without prescan, thereby optimizing the efficiency of document processing.

SUMMARY OF THE INVENTION

Therefore, an object of the invention is to provide a document property detecting device that is capable of making the detection of document property more convenient by using the configuration of the transparent conductive substrate on the flatbed.

Another object of the invention is to provide a document property detecting device that is capable of detecting the document property without prescan.

Still another object of the invention is to provide a document property detecting device having conveniences over its design, thereby enabling the flatbed of the document property detecting device to be thin in volume.

The document property detecting device of the invention comprises a circuit including a first electrode and a plurality of second electrodes; a transparent conductive substrate for loading a document and electrically connected to the first electrode; and a cover with a plurality of conductive media electrically connected to the second electrodes. The cover further comprises a platen element on which the plurality of conductive media are fixed.

In a preferred embodiment of the invention, the transparent conductive substrate is substantially a transparent glass plated with a layer of transparent conductive film, which may be an indium tin oxide (ITO) film. Also, the conductive media are substantially a plurality of electrodes, or may be replaced by a plurality of electronic probes or a plurality of electronic sensors.

It is to be noted that, the conductive media in the invention may be simple electrode configurations, contact electronic probes or other conductive materials. The transparent conductive film plated on the transparent conductive substrate may also be any other transparent conductive film besides the ITO film. Because the document property detecting device of the present invention adopts a transparent conductive glass to load the document and employs conductive media to determine the document property by judging that whether or not the conductive media are in contact with the transparent glass, the document property detecting device has the following advantages:

1. the document property detecting device is capable of detecting the document property without prescan, thereby optimizing the efficiency of document processing, 2. the configuration and number of the conductive media may be easily controlled to accommodate the requirements of the designer, and
3. the document property detecting device is capable of detecting documents of non-standard sizes and punched documents.

DESCRIPTION OF THE PREFERRED EMBODIMENT

Figure 1:
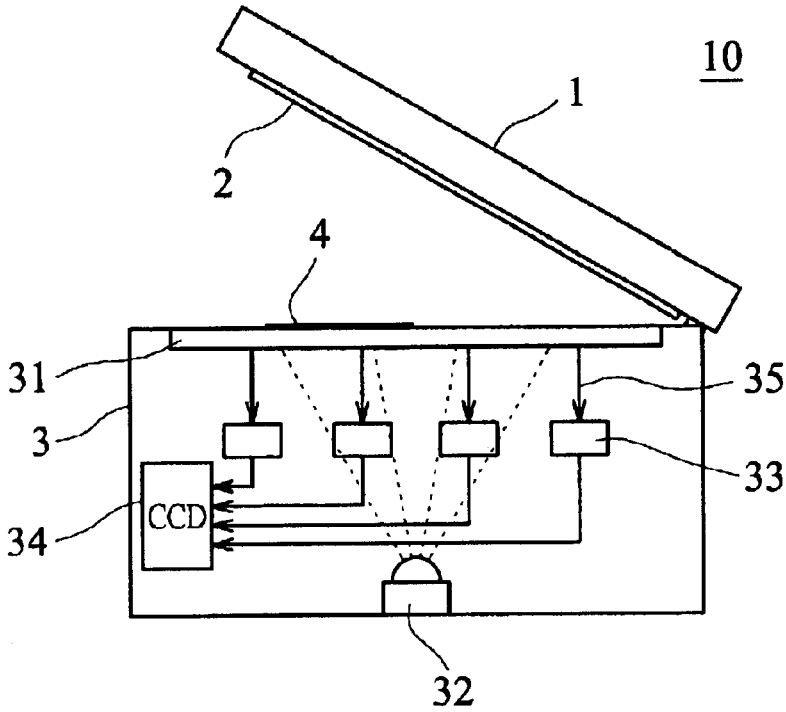
FIG. 1 (PRIOR ART)
FIG. 1 shows a schematic diagram of the structure of a prior flatbed scanner.
Figure 2:
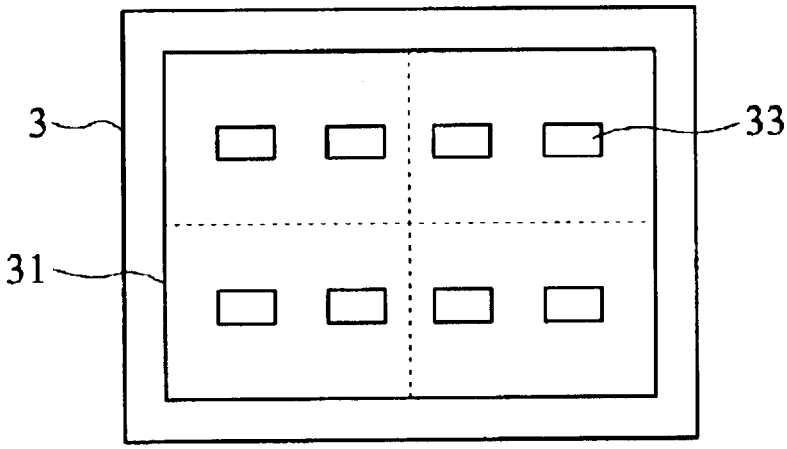
FIG. 2 (PRIOR ART)
FIG. 2 is a plane diagram from top view of the flatbed body of FIG. 1, mainly showing the configuration of the photosensors provided beneath the transparent glass.
Figure 3:
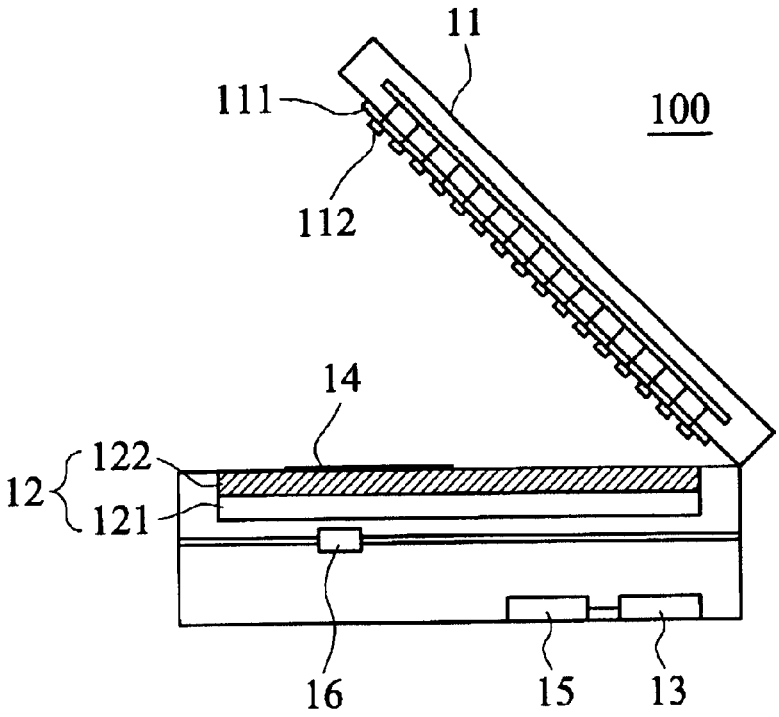
FIG. 3 shows the brief diagram of the structure of the document property detecting device in accordance with an embodiment of the invention.
Figure 4:
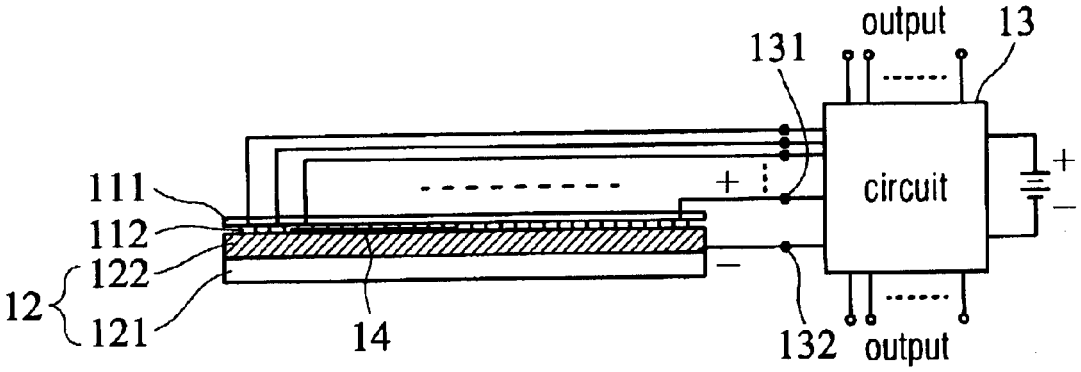
FIG. 4 is a schematic diagram showing the contact relation between the transparent conductive substrate and the conductive media when the platen element comes into contact with the transparent conductive substrate and the document in the document property detecting device in accordance with the embodiment of the invention.

An illustration is given in connection with an embodiment of the invention below with reference to FIG. 3 and FIG. 4. As shown in FIG. 3, the document property detecting device 100 in accordance with an embodiment of the invention mainly includes a cover 11, a transparent conductive substrate 12 and a circuit 13. A platen element 111 used for fixing a document 14 is provided at the lower surface of the cover 11 therein during document property (including size and/or location) detection. A plurality of conductive media 112 such as probes are further provided on the platen element 111, and the conductive media 112 are electrically connected to a positive electrode 131 in the circuit 13. The transparent conductive substrate 12 is chiefly made of a transparent glass 121, which is plated with a conductive film 122, an ITO film, for example, and the conductive film 122 is electrically connected to a negative electrode 132 in the circuit 13.

With respect to the embodiment of the invention, when a document 14 is loaded on the transparent conductive substrate 12 for document copying or scanning, the platen element 111 of the cover 11 in the document property detecting device of the invention covers the entire document 14 and the transparent conductive substrate 12. FIG. 4 is a schematic illustration showing the relation between the transparent conductive substrate 12, the conductive media and the circuit 13 when the platen element 111 is in contact with the transparent conductive substrate 12 and the document 14. At this point, the conductive media 112 are unable to be in contact with the conductive film 122 on the transparent conductive substrate 13 at the area where the document 14 is loaded due to the separation by the document 14, while the other part of the conductive film 122 on the transparent conductive substrate 12 is able to be in contact with the conductive media 112 without any separation caused by any document. Under the circumstance that the circuit 13 is originally designed to be non-conductive, at least one conductive electric signal such as ON or 1 is produced in the circuit 13 at the area where the transparent conductive film 122 and the conductive media 112 come into contact as a result of the conductive film 122 and the conductive media 122 being electrically connected to the negative electrode 132 and the positive electrode 131, respectively. Moreover, at least one non-conductive signal such as OFF or 0 is produced in the circuit 13 at the area where the transparent conductive film 122 and the conductive media 112 do not come into contact, that is, where the document is loaded. Subsequently, the size and/or location of the document can be determined by using a computer or a CPU receiving these ON and OFF signals via the circuit 13, or by using a logic decision unit. Hence, the embodiment of the invention further includes a logic decision unit 15 (FIG. 3). In addition, the embodiment of the invention further includes a scanning module 16 with which the embodiment becomes a scanning device having an image scanning function. The scanning module 16 situated beneath the transparent conductive substrate 12 is configured to be movable, and is used for scanning the document whose size and/or location is determined as described.

It is to be noted that, the conductive media 112 in the invention may be simple electrode configurations, contact electronic probes or other conductive materials. The transparent conductive film plated on the transparent conductive substrate may also be any other transparent conductive film besides the ITO film. On the other hand, although the circuit 13 in the embodiment of the invention is originally designed to be non-conductive and becomes conductive after the cover 11 and the transparent conductive substrate 12 come into contact, the circuit of the invention may also be designed to be originally conductive and becomes non-conductive after the cover and the transparent conductive substrate come into contact, thereby determining the size and location of the document by detecting the area being conducted.

Figure 5:
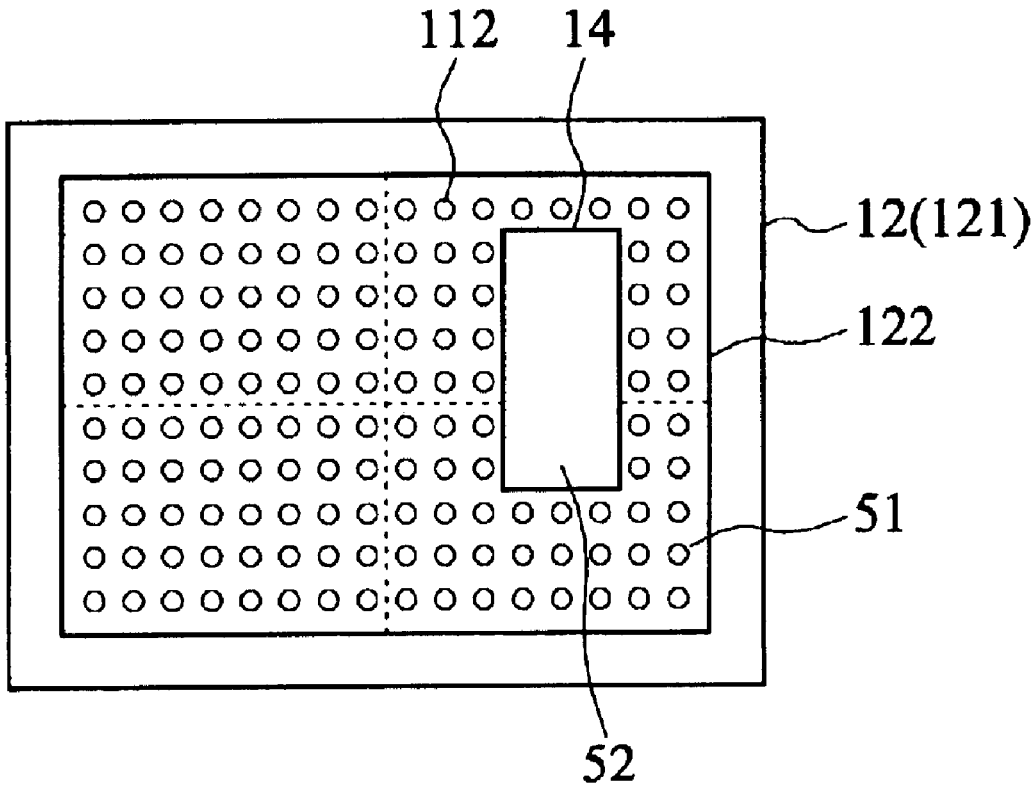
FIG. 5 is a plane diagram from top view showing the contact area and non-contact area of the conductive media and the transparent conductive film on the transparent conductive substrate of the document property detecting device in accordance with the embodiment of the invention.

FIG. 5 is a plane diagram from top view showing the contact area 51 and the non-contact area 52 resulting from the contact of conductive media 12 and the transparent conductive film 122 situated on the transparent conductive substrate 12 in the document size detecting device in accordance with the embodiment of the invention. The conductive media 112 in the embodiment of the invention are simple electrodes or electronic probes provided at the exterior of the flatbed body (on the cover), and therefore they have advantages as being small in volume and easily configured compared to photosensors in prior document size detecting devices. Referring to FIG. 5, the conductive media 112 in the platen 111 of the cover 11 may be numerous in order to accurately detect the size and location of the document 14. Moreover, even when the document 14 loaded on the transparent conductive substrate 12 is irregular in shape, the size and location of the document 14 may also be detected through the contact area 51 and non-contact area 52 defined by the conductive media 112 and the transparent conductive film 122.

It is to be regarded that the number of the conductive media in the embodiment of the invention may be determined according to the requirement of the designer. As a result, as for the circumstances in which the documents are punched, we can still avoid any misjudge in the size and location of the document by providing numerous conductive media and using the logic decision design of the circuit to omit the conductive areas over the punched holes.

In conclusion, while the invention has been described by way of an example and in terms of the preferred embodiment, it is to be understood that the invention is not limited to the disclosed embodiment. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A document property detecting device comprising:

a circuit comprising a first electrode and a plurality of second electrodes;

a transparent conductive substrate for loading a document and electrically connected to the first electrode; and a cover comprising a plurality of conductive media which are electrically connected to the second electrodes, respectively.

2. The document property detecting device as described in claim 1, wherein the cover further comprises a platen element on which the conductive media are fixed.

3. The document property detecting device as described in claim 1, wherein the transparent conductive substrate is substantially a transparent glass on which a layer of transparent conductive film is plated.

4. The document property detecting device as described in claim 3, wherein the transparent conductive film is an ITO (indium tin oxide) film.

5. The document property detecting device as described in claim 1, wherein the conductive media are substantially a plurality of electrodes.

6. The document property detecting device as described in claim 1, wherein the conductive media include a plurality of electronic probes.

7. The document property detecting device as described in claim 1, wherein when the cover is covered and pressed on the document and the transparent conductive substrate, the conductive media in contacting with the document enable the circuit to produce at least one non-conductive signal, and the conductive media in contacting with the transparent conductive substrate enable the circuit to produce at least one conductive signal.

8. The document property detecting device as described in claim 7, further comprising a logic decision unit for determining the size of the document by the at least one conductive signal and the at least one non-conductive signal.

9. The document property detecting device as described in claim 8, further comprising a scanning module movably mounted beneath the transparent conductive substrate for scanning the document according to the determined size of the document.

10. The document property detecting device as described in claim 7, further comprising a logic decision unit for determining the location of the document by the at least one conductive signal and the at least one non-conductive signal.

11. The document property detecting device as described in claim 10, further comprising a scanning module movably mounted beneath the transparent conductive substrate for scanning the document according to the determined location of the document.

* * * * *